US007279830B2

(12) United States Patent
Lee et al.

(10) Patent No.: US 7,279,830 B2
(45) Date of Patent: Oct. 9, 2007

(54) ELECTRON EMISSION DEVICE

(75) Inventors: Sang-Jo Lee, Suwon-si (KR); Chun-Gyoo Lee, Suwon-si (KR); Sang-Hyuck Ahn, Suwon-si (KR); Su-Bong Hong, Suwon-si (KR); Byong-Gon Lee, Suwon-si (KR); Sang-Ho Jeon, Suwon-si (KR); Yong-Soo Choi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 196 days.

(21) Appl. No.: 11/068,067

(22) Filed: Feb. 26, 2005

(65) Prior Publication Data

US 2005/0189870 A1 Sep. 1, 2005

(30) Foreign Application Priority Data

Feb. 26, 2004 (KR) ..... 10-2004-0012953
Oct. 28, 2004 (KR) ..... 10-2004-0086671

(51) Int. Cl.
*H01J 1/304* (2006.01)
*H01J 1/46* (2006.01)

(52) U.S. Cl. ..... 313/497; 313/496; 313/495

(58) Field of Classification Search ..... 313/309–311, 313/495–497

See application file for complete search history.

(56) References Cited

U.S. PATENT DOCUMENTS 5,828,288 A 10/1998 Jones et al.
6,262,530 B1 7/2001 Prein
6,621,232 B2 9/2003 Jo et al.

FOREIGN PATENT DOCUMENTS

CN 1430241 7/2003
DE 19536197 A1 4/1997

OTHER PUBLICATIONS

European Search Report for application No. 05101406.6, dated Jul. 26, 2005, in the name of Samsung SDI Co., Ltd.

*Primary Examiner*—Karabi Guharay
(74) *Attorney, Agent, or Firm*—Christie, Parker & Hale, LLP

(57) ABSTRACT

An electron emission device includes gate electrodes formed on a substrate. The gate electrodes are located on a first plane. An insulating layer is formed on the gate electrodes. Cathode electrodes are formed on the insulating layer. Electron emission regions are electrically connected to the cathode electrodes. The electron emission regions are located on a second plane. In addition, the electron emission device includes counter electrodes placed substantially on the second plane of the electron emission regions. The gate electrodes and the counter electrodes are for receiving a same voltage, and a distance, D, between at least one of the electron emission regions and at least one of the counter electrodes satisfies the following condition: 1(μm) ≦D≦28.1553+1.7060t(μm), where t indicates a thickness of the insulating layer.

28 Claims, 13 Drawing Sheets

ELECTRON EMISSION DEVICE

CROSS-REFERENCE TO RELATED APPLICATION

This application claims the benefit of and priority to Korean Patent Application No. 10-2004-0012953 filed on Feb. 26, 2004 and Korean Patent Application No. 10-2004-0086671 filed on Oct. 28, 2004 in the Korean Intellectual Property Office, the entire content of each of which is incorporated herein by reference.

BACKGROUND OF THE INVENTION

1. Field of the Invention

The present invention relates to an electron emission device, and in particular, to an electron emission device which has gate electrodes placed at the same plane as electron emission regions to induce the emission of electrons from the latter.

2. Description of Related Art

Generally, the electron emission devices can be classified into two types. A first type uses a hot (or thermo-ionic) cathode as an electron emission source, and a second type uses a cold cathode as the electron emission source.

Also, in the second type electron emission devices, there are a field emitter array (FEA) type, a metal-insulator-metal (MIM) type, a metal-insulator-semiconductor (MIS) type, and a surface-conduction emission (SCE) type.

The MIM-type and the MIS-type electron emission devices have either a metal/insulator/metal (MIM) electron emission structure or a metal/insulator/semiconductor (MIS) electron emission structure. When voltages are applied to the metals or the semiconductor, electrons are migrated from the metal or semiconductor having a high electric potential to the metal having a low electric potential, and accelerated to thereby emit electrons.

The SCE-type electron emission device includes first and second electrodes formed on a substrate while facing each other, and a conductive thin film disposed between the first and the second electrodes. Micro-cracks are made at the conductive thin film to form electron emission regions. When voltages are applied to the electrodes while making the electric current flow to the surface of the conductive thin film, electrons are emitted from the electron emission regions.

The FEA-typed electron emission device is based on the principle that when a material having a low work function or a high aspect ratio is used as an electron emission source, electrons are easily emitted from the material due to the electric field in a vacuum atmosphere. A front sharp-pointed tip structure based on molybdenum, silicon, or a carbonaceous material, such as carbon nanotube, graphite and/or diamond-like carbon, has been developed to be used as the electron emission source.

Generally, a cold cathode-based electron emission device has first and second substrates forming a vacuum vessel. Electron emission regions, and driving electrodes for controlling the electron emission of the electron emission regions, are formed on the first substrate. Phosphor layers, and an electron acceleration electrode for effectively accelerating the electrons emitted from the side of the first substrate toward the phosphor layers are formed on the second substrate to thereby emit light and/or display desired images.

The FEA-type electron emission device has a triode structure where cathode and gate electrodes are formed on the first substrate as the driving electrodes, and an anode electrode is formed on the second substrate as the electron acceleration electrode. The cathode and the gate electrodes are placed at different planes, and separately receive different voltages such that electrons are emitted from the electron emission regions that are electrically connected to the cathode electrodes.

With the FEA-type electron emission device, the amount of electrons emitted from the electron emission regions is exponentially increased with respect to the intensity of the electric field (E) formed around the electron emission regions. The intensity of the electric field (E) may be proportional to the voltage applied to the gate electrodes, and to the closeness of the electron emission regions to the gate electrodes.

However, with the currently available electron emission devices, the intensity of the electric field (E) is not maximized due to the structural limitation of the gate electrodes so that the amount of electrons emitted from the electron emission regions cannot be significantly increased, and this makes it difficult to realize a high luminance screen.

Of course, the voltage applied to the gate electrodes may be heightened to solve the above problem. However, in such a case, it becomes difficult to make widespread usage of the electron emission device due to the increased power consumption, and with the use of a high cost driver, the production cost of the electron emission device is increased.

SUMMARY OF THE INVENTION

In one aspect of the present invention, there is provided an electron emission device which can increase the amount of emitted electrons without heightening the driving voltage for making the electron emission.

In an exemplary embodiment of the present invention, an electron emission device includes gate electrodes formed on a substrate. The gate electrodes are located on a first plane. An insulating layer is formed on the gate electrodes. Cathode electrodes are formed on the insulating layer. Electron emission regions are electrically connected to the cathode electrodes. The electron emission regions are located on a second plane. In addition, the electron emission device includes counter electrodes placed substantially on the second plane of the electron emission regions. The gate electrodes and the counter electrodes are for receiving a same voltage, and a distance, D, between at least one of the electron emission regions and at least one of the counter electrodes satisfies the following condition: $1(\mu m) \leqq D \leqq 28.1553+1.7060t(\mu m)$, where t indicates a thickness of the insulating layer.

In an exemplary embodiment of the present invention, an electron emission device includes gate electrodes formed on a substrate. The gate electrodes are located on a first plane. An insulating layer is formed on the gate electrodes. Cathode electrodes are formed on the insulating layer. Electron emission regions are electrically connected to the cathode electrodes. The electron emission regions are located on a second plane. In addition, the electron emission device includes counter electrodes placed substantially on the second plane of the electron emission regions. The gate electrodes and the counter electrodes are for receiving a same voltage, and when voltages are applied to the cathode electrodes and the gate electrodes, one or more inflection points of an electric field intensity are present. Furthermore, when a distance between at least one of the electron emission regions and at least one of the counter electrodes is indicated by D, and a largest distance between the at least one electron emission region and the at least one counter electrode at the inflection points is indicated by d1, the distance, D, between the at least one electron emission region and the at least one counter electrode satisfies the following condition: 1(μm)≦D≦d1(μm).

The distance, D, between the at least one electron emission region and the at least one counter electrode may satisfy the following two conditions: 1(μm)≦D≦28.1553+1.7060t (μm), and 0.5(μm)≦t≦30(μm), where t indicates a thickness of the insulating layer.

In an exemplary embodiment of the present invention, an electron emission device includes gate electrodes formed on a substrate. The gate electrodes are located on a first plane. An insulating layer is formed on the gate electrodes. Cathode electrodes are formed on the insulating layer. Electron emission regions are electrically connected to the cathode electrodes. The electron emission regions are located on a second plane. In addition, the electron emission device includes counter electrodes placed substantially on the second plane of the electron emission regions. The gate electrodes and the counter electrodes are for receiving a same voltage, and at least one of the electron emission regions and at least one of the counter electrodes are spaced apart from each other with a distance of about 1 to 30 μm.

The gate electrodes may be positioned closer to the substrate than the cathode electrodes. Furthermore, the counter electrodes may be formed on the insulating layer while contacting the gate electrodes through via holes formed at the insulating layer.

In an exemplary embodiment of the present invention, an electron emission device includes first cathode electrodes formed on a first substrate. The first cathode electrodes are located on a first plane. An insulating layer is formed on the first cathode electrodes. Gate electrodes are formed on the insulating layer. The gate electrodes are located on a second plane. In addition, the electron emission device includes second cathode electrodes and electron emission regions. The second cathode electrodes are placed substantially on the second plane of the gate electrodes, and the second cathode electrodes and the first cathode electrodes are for receiving a same voltage. The electron emission device is electrically connected to the second cathode electrodes, and at least one of the electron emission regions and at least one of the gate electrodes are spaced apart from each other with a distance of about 1 to 30 μm.

The first cathode electrodes may be positioned closer to the substrate than the gate electrodes. The second cathode electrodes may be formed on the insulating layer while contacting the first cathode electrodes through via holes formed at the insulating layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, exemplary embodiments of the present invention are shown and described by way of illustration. Accordingly, the drawings and description are to be regarded as illustrative in nature, and not restrictive.

An electron emission device according to a first embodiment of the present invention will be now explained with reference to FIGS. 1 to 8.

Figure 1:
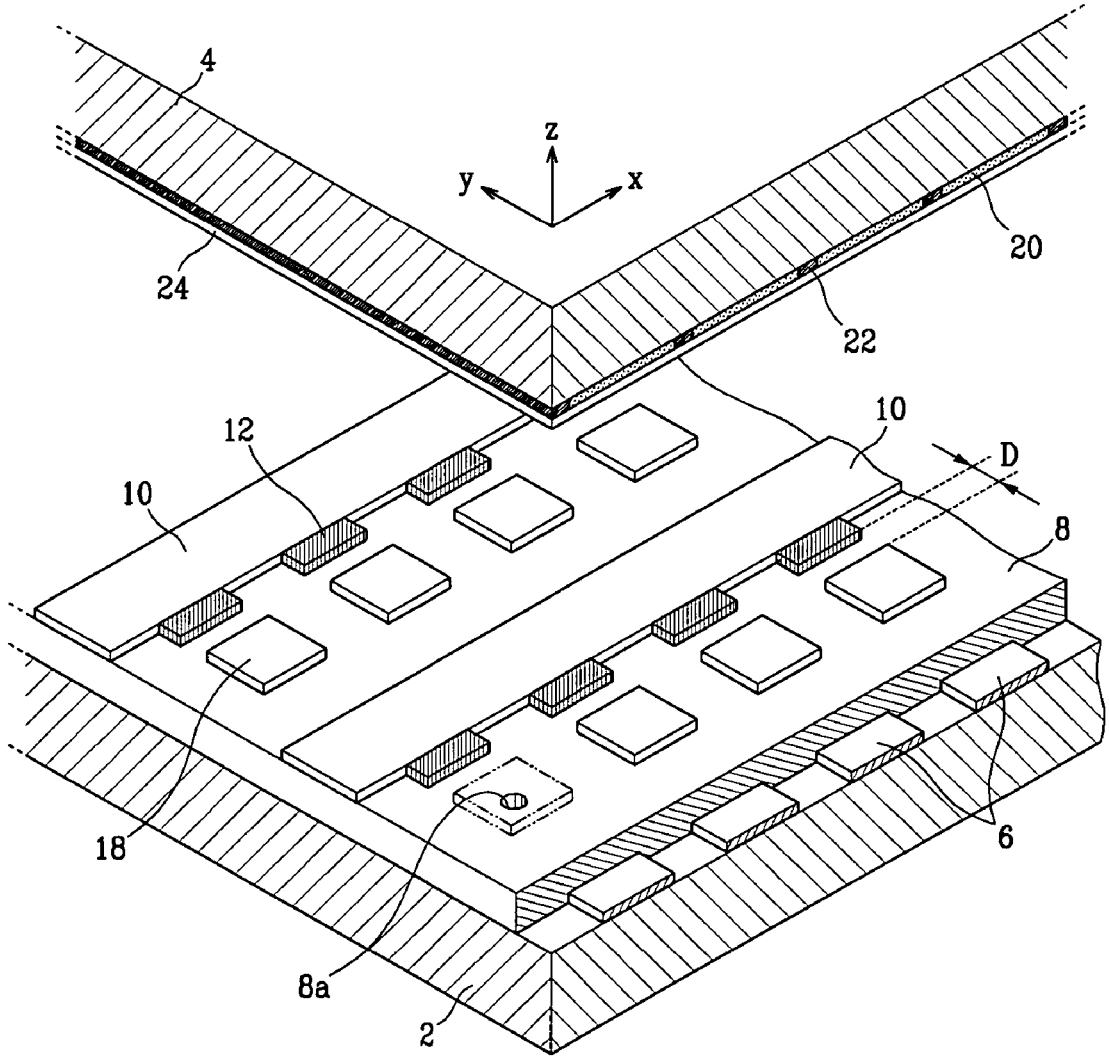
FIG. 1 is a partial exploded perspective view of an electron emission device according to a first embodiment of the present invention.
Figure 2:
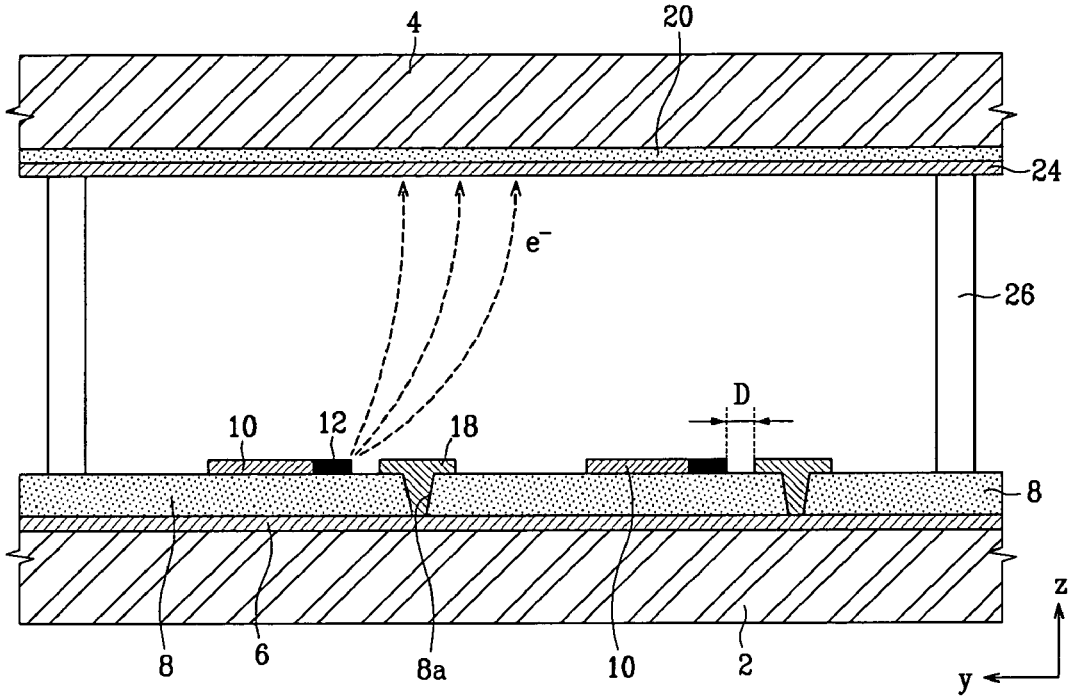
FIG. 2 is a partial sectional view of the electron emission device according to the first embodiment of the present invention.
Figure 3:
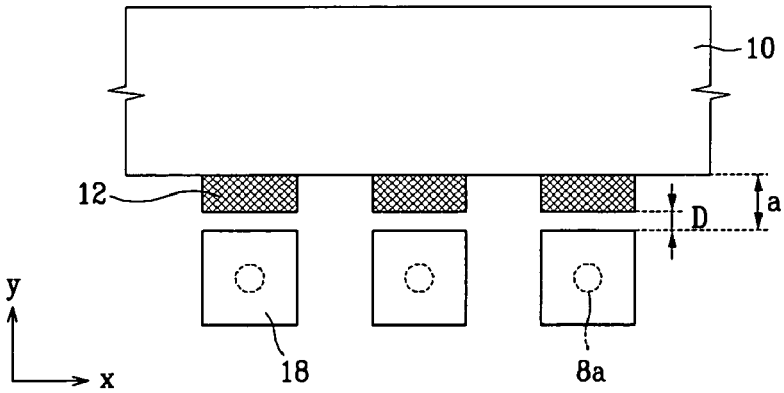
FIG. 3 is a partial plan view of the first substrate shown in FIG. 1.

As shown in FIGS. 1 to 3, the electron emission device of the first embodiment includes first and second substrates 2 and 4 arranged parallel to each other with a predetermined distance to form an inner space. To emit light and/or display desired images, an electron emission structure is provided at the first substrate 2 to emit electrons, and a light emission or display structure is provided at the second substrate 4 to emit visible rays due to the electrons.

Specifically, gate electrodes 6 are stripe-patterned on the first substrate 2 in a first direction of the first substrate 2 (e.g., in a y-axis direction of FIG. 1). An insulating layer 8 is formed on the entire surface of the first substrate 2 to cover the gate electrodes 6. Cathode electrodes 10 are stripe-patterned on the insulating layer 8 in a second direction crossing the gate electrodes 6 (e.g., in an x-axis direction of FIG. 1).

Electron emission regions 12 are formed at one-sided portions of the cathode electrodes 10 while partially contacting the cathode electrodes 10 such that they are electrically connected to the cathode electrodes 10. The electron emission regions 12 are provided at the respective pixel regions defined on the first substrate 2 where the gate and the cathode electrodes 6 and 10 cross each other.

Figure 4:
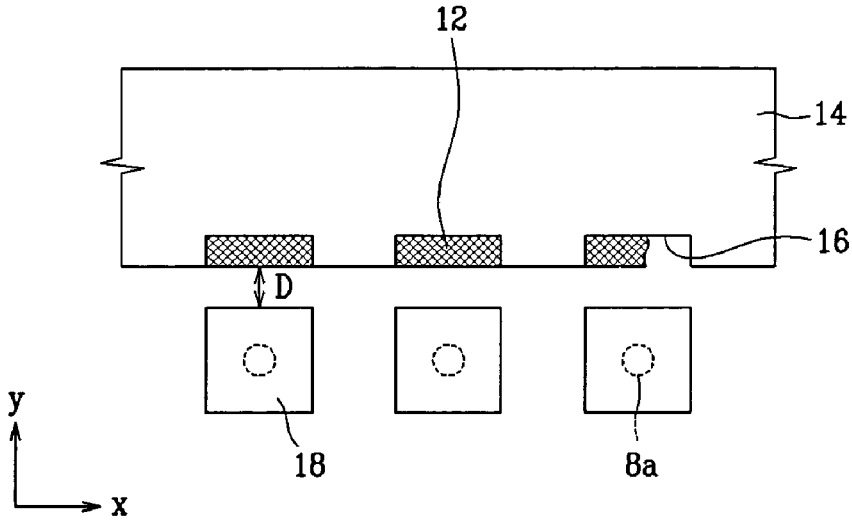
FIG. 4 is a partial plan view of the first substrate, illustrating a variant of the cathode electrodes and the electron emission regions.

The electron emission regions 12 are formed on the insulating layer 8 while contacting the one-sided portions of the cathode electrodes 10 with a predetermined width. Alternatively, as shown in FIG. 4, grooves 16 may be formed at one-sided portions of cathode electrodes 14 to receive electron emission regions 12, and the electron emission regions 12 are placed within the grooves 16 while contacting lateral sides of the cathode electrodes 14.

The electron emission regions 12 are formed with a material for emitting electrons under the application of an electric field. The material can be a carbonaceous material and/or a nanometer-sized material. In addition, the electron emission regions 12 can be formed with carbon nanotube, graphite, graphite nanofiber, diamond, diamond-like carbon, C60, silicon nanowire, and/or a combination thereof. The electron emission regions 12 may be formed through screen printing, chemical vapor deposition, direct growth, and/or sputtering.

Counter electrodes 18 (which may also be referred to as second gate electrodes) are formed on the insulating layer 8 while being electrically connected to the gate electrodes 6 to receive the same voltage as the latter. The counter electrodes 18 contact the gate electrodes 6 through via holes 8*a* formed at the insulating layer 8 while being electrically connected thereto. The counter electrodes 18 are arranged at respective pixel regions defined on the first substrate 2 while being spaced apart from the electron emission regions 12 and between the cathode electrodes 10 (or the cathode electrodes 14).

As shown in FIGS. 1 to 4, the counter electrodes 18 are roughly a squared-shape, but the shape thereof is not limited thereto. That is, the shape of the counter electrodes 18 may be altered or modified in various manners.

In operation and referring now to FIGS. 1 to 3, when predetermined driving voltages are applied to the gate and the cathode electrodes 6 and 10 to form electric fields around the electron emission regions 12, the counter electrodes 18 further form electric fields at the lateral sides of the electron emission regions 12. Accordingly, even though a low driving voltage is applied to the gate electrodes 6, the counter electrodes 18 make it possible to enhance emission from the electron emission regions 12.

With the above structure, the gate electrode 6 has the role of a first electrode placed at the plane different from the cathode electrode 10 to form an electric field for emitting electrons, and the counter electrode 18 has the role of a second electrode placed at the same plane as the electron emission region 12 to additionally form the electric field for emitting electrons.

Also, with the structure where the counter electrodes 18 are formed on the insulating layer 8, the electron emission regions 12 are partially or wholly placed closer to the counter electrodes 18 than to one-sided peripheries of the cathode electrodes 10 facing the counter electrodes 18. That is, as shown in FIG. 3, the shortest distance, D, between the electron emission region 12 and the counter electrode 18 is smaller than the shortest distance, a, between the cathode electrode 10 and the counter electrode 18, and in this case, the distance between the electron emission region 12 and the counter electrode 18 is reduced.

Red, green and blue phosphor layers 20 are formed on the surface of the second substrate 4 facing the first substrate 2, and black layers 22 are disposed between the phosphor layers 20 to enhance the screen contrast. An anode electrode 24 is formed on the phosphor layers 20 and the black layers 22 with a metallic material, such as aluminum, through deposition.

The anode electrode 24 receives direct current voltages of several tens to several thousands of volts from the outside, and accelerates the electrons emitted from the side of the first substrate 2 toward the phosphor layers 20. In addition, the anode electrode 24 reflects the visible rays radiated toward the first substrate 2 from the phosphor layers 20 to the side of the second substrate 4 to further enhance the screen luminance.

Alternatively, the anode electrode 24 may be formed with a transparent conductive material, such as indium tin oxide (ITO). In this case, the anode electrode (not shown) is placed on the surfaces of the phosphor layers 20 and the black layers 22 facing the second substrate 4. The anode electrode may be formed on the entire surface of the second substrate 4, or partitioned into plural portions with a predetermined pattern.

Referring now still to FIGS. 1 to 3, the first and the second substrates 2 and 4 are arranged such that the cathode and the anode electrodes 10 and 24 face each other, and are attached to each other at their peripheries via a seal frit. The inner space between the first and the second substrates 2 and 4 is exhausted to be in a vacuum state to thereby construct an electron emission device. In addition, a plurality of spacers 26 are arranged at the non-light emission area between the first and the second substrates 2 and 4 to space them apart from each other with a predetermined distance.

The above-structured electron emission device is driven by supplying a predetermined voltage to the gate electrodes 6, the cathode electrodes 10, and the anode electrode 24 from the outside. For instance, the cathode electrodes 10 receive minus (−) scanning voltages of several to several tens of volts to function as the scanning electrodes, and the gate and the counter electrodes 6 and 18 receive plus (+) data voltages of several to several tens of volts to function as the data electrodes.

Of course, plus (+) voltages may be applied to all the cathode and the gate electrodes 10 and 6 to drive them. That is, it may be established with the electron emission device that when the cathode electrode 10 receives a ground voltage (for example, 0V) and the gate electrode 6 receives a plus (+) voltage of several tens of volts, the pixels turn on, and when all the cathode and the gate electrodes 10 and 6 receive a plus (+) voltage of several tens of volts, the pixels turn off.

Accordingly, electric fields are formed at the bottom sides of the electron emission regions 12 where the gate electrodes 6 are placed, and at the lateral sides of the electron emission regions 12 where the counter electrodes 18 are formed, due to the voltage difference between the cathode electrodes 10 and the gate electrodes 6. The electrons emitted from the electron emission regions 12 are attracted toward the second substrate 4 by the high voltage applied to the anode electrode 24, and collide against the corresponding phosphor layers 20 to thereby emit light.

In operation, the intensity of the electric field applied to the electron emission regions 12 is closely related to the voltage applied to the gate electrodes 6, the thickness of the insulating layer 8, and the distance between the electron emission region 12 and the counter electrode 18.

In this embodiment, an electron emission region 12 and a counter electrode 18 are spaced apart from each other with an optimal distance to maximize the intensity of the electric field applied to the electron emission region 12, and to minimize the leakage of current between the electron emission region 12 and the counter electrode 18. The distance between the electron emission region 12 and the counter electrode 18 is indicated by the dimension measured in the plane of the first substrate 2.

Figure 5:
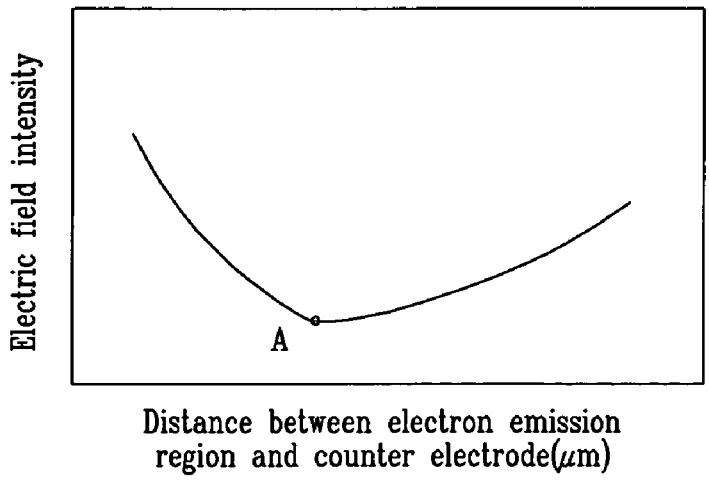
FIG. 5 is a graph for illustrating the variation pattern in the intensity of the electric field applied to the electron emission regions depending upon the variation in the distance between the electron emission regions and the counter electrodes.

FIG. 5 schematically illustrates the variation pattern in the intensity of the electric field applied to the electron emission region depending upon the variation in the distance between the electron emission region and the counter electrode. As shown in FIG. 5, an inflection point A, where the electric field value is first decreased and then increased, is existent at the electric field intensity line at a certain distance between the electron emission region and the counter electrode.

In a case where one inflection point is existent, the maximum value of the distance D between the electron emission region 12 and the counter electrode 18 can be the distance between the electron emission region 12 and the counter electrode 18 at that inflection point. In a case where two or more inflection points are existent, the maximum value of the distance D between the electron emission region 12 and the counter electrode 18 can be the largest distance between the electron emission region and the counter electrode 18 at those inflection points, or the smallest distance between the electron emission region 12 and the counter electrode 18 at those inflection points. In one embodiment, the smallest distance between the electron emission region 12 and the counter electrode 18 is used.

The location of the inflection point at the electric field intensity line is differentiated depending upon the thickness of the insulating layer 8 under the same driving conditions. That is, the smaller the thickness of the insulating layer 8, the more the electron emission regions 12 are affected by the electric field due to the gate electrodes 6. In a case where the insulating layer 8 is formed through a thin film formation process, such as deposition, it can have a thickness of about 0.5-1 μm. In a case where the insulating layer 8 is formed through a thick film formation process, such as screen printing, it can have a thickness of about 10-30 μm.

When the thickness of the insulating layer 8 is indicated by t, the distance D between the electron emission region 12 and the counter electrode 10 with the presence of the inflection point can be expressed by the following:

$$D=28.1553+1.7060t(\mu m) \quad (1).$$

In a case where one or more inflection points are present at the electric field intensity line, the expression 1 refers to the location of the inflection point with the smallest distance value.

Figure 6A:
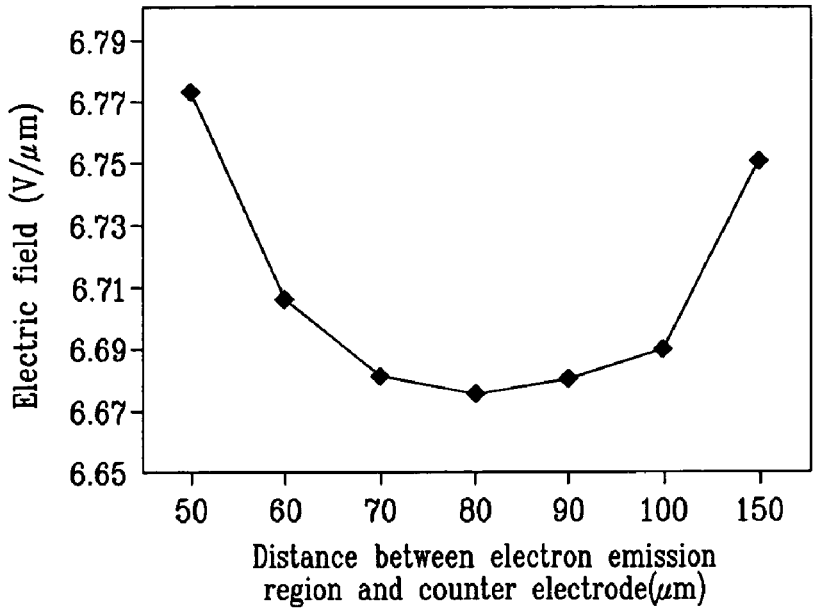
FIGS. 6A, 6B, and 6C are graphs illustrating the electric field intensity of the electron emission regions measured in accordance with the variation in the distance between the electron emission regions and the counter electrodes when the thickness of the insulating layer is 30 μm, 25 μm and 1 μm.
Figure 6B:
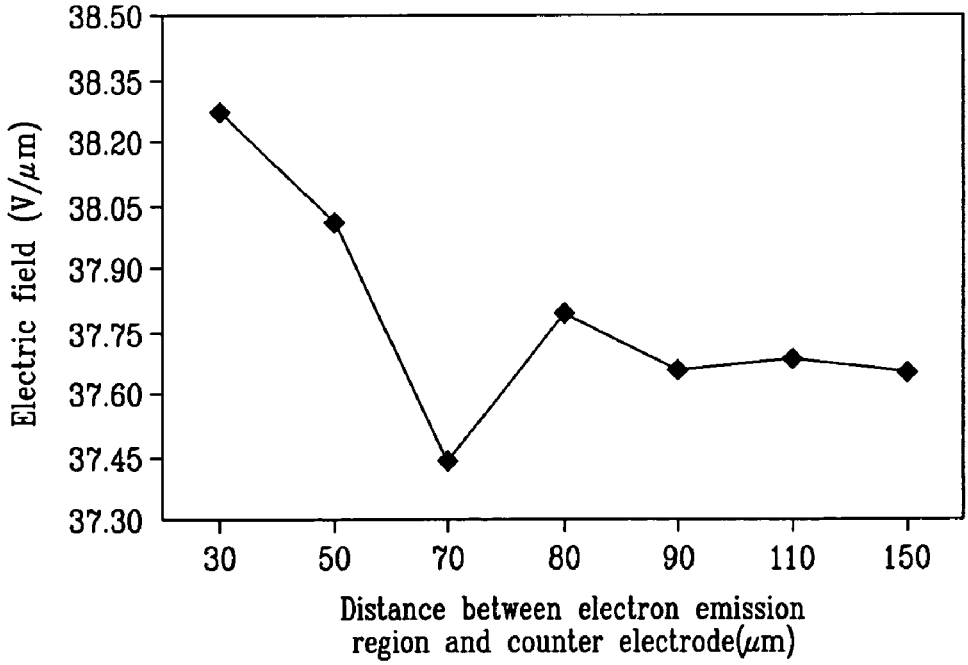
Figure 6C:
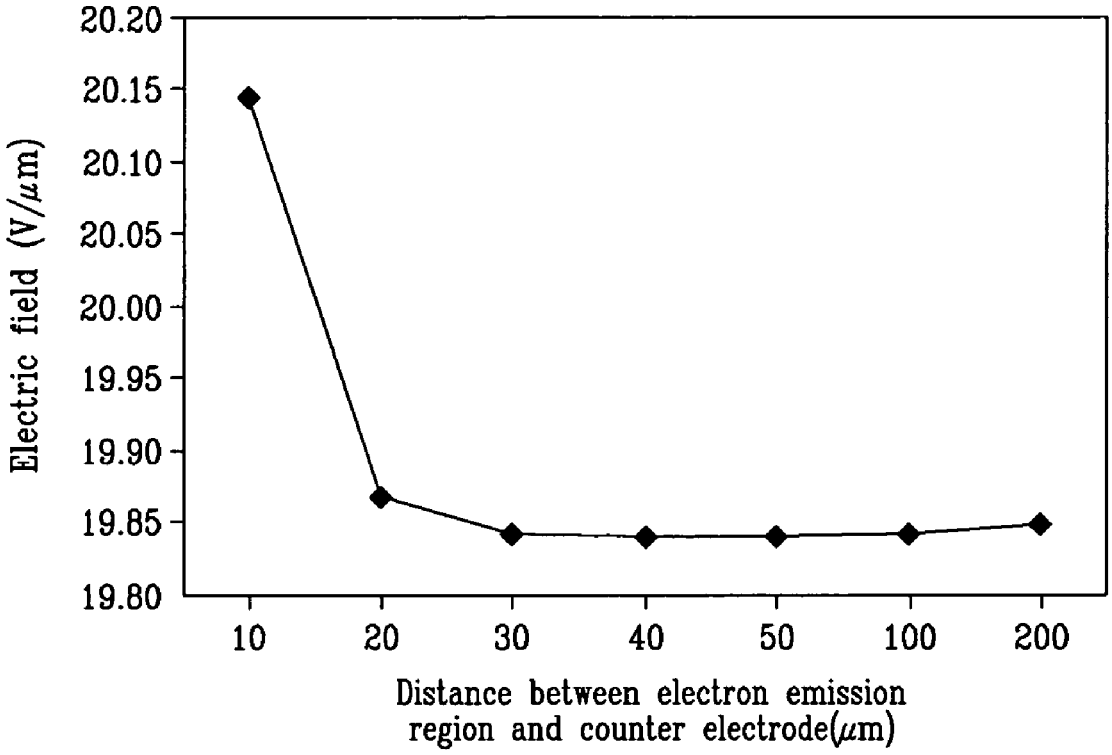

FIGS. 6A, 6B, and 6C are graphs illustrating the electric field intensity of the electron emission region depending upon the variation in the distance between the electron emission region and the counter electrode when the thickness of the insulating layer is about 30 μm, 25 μm, and 1 μm, respectively. In these three cases, the electron emission devices have the same structure except for the thickness of the insulating layer. In FIGS. 6A, 6B, and 6C, the results of the experiments were conducted when about 70V is applied to the gate electrodes, about −80V is applied to the cathode electrodes, and about 4 kV is applied to the anode electrode as illustrated.

As shown in FIG. 6A, an inflection point, where the electric field intensity is first decreased and then increased as the distance between the electron emission region and the counter electrode is changed (increased or reduced), is present where the distance between the electron emission region and the counter electrode is about 80 μm.

Accordingly, when the thickness of the insulating layer is about 30 μm, the maximum distance between the electron emission region and the counter electrode is established to be about 80 μm.

As shown in FIG. 6B, two inflection points are present where the distance between the electron emission region and the counter electrode is about 70 μm, and is about 90 μm, respectively. Accordingly, when the thickness of the insulating layer is about 25 μm, the maximum distance between the electron emission region and the counter electrode is established to be about 90 μm, or to be about 70 μm.

As shown in FIG. 6C, an inflection point is present where the distance between the electron emission region and the counter electrode is about 30 μm. Accordingly, when the thickness of the insulating layer is about 1 μm, the maximum distance between the electron emission region and the counter electrode is established to be about 30 μm.

As described above, the maximum distance between the electron emission region 12 and the counter electrode 18 is determined based on the inflection point at the graph illustrating the electric field intensity. The smaller the distance between the electron emission region 12 and the counter electrode 18, the more the intensity of the electric field applied to the electron emission region 12 is heightened, thereby increasing the amount of emitted electrons.

Figure 7:
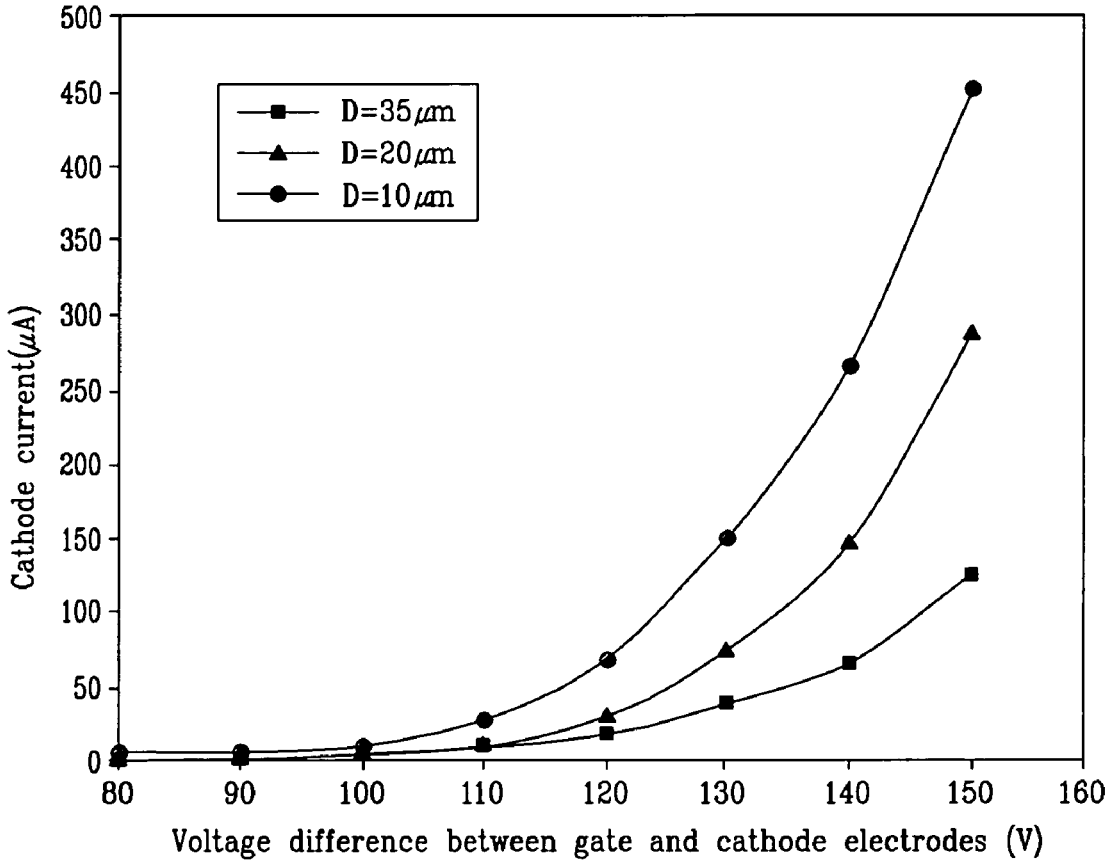
FIG. 7 is a graph illustrating the variation in the cathode current depending upon the voltage difference between the gate electrodes and the cathode electrodes.

FIG. 7 illustrates the variation in the cathode electric current as a function of the voltage difference between the gate electrode and the cathode electrode when the distance between the electron emission region and the counter electrode is about 35 μm, 20 μm, and 10 μm, respectively. The cathode electric current refers to the amount of electrons emitted from the electron emission regions. In this experiment, the thickness of the insulating layer is about 20 μm, and about 70V is applied to the gate electrodes, about −80V is applied to the cathode electrodes, and about 4 kV is applied to the anode electrode.

It can be derived from FIG. 7 that within the range satisfying the condition of the maximum distance between the electron emission region and the counter electrode, the smaller the distance between the electron emission region and the counter electrode, the more the amount of electrons emitted from the electron emission regions is increased.

Figure 8:
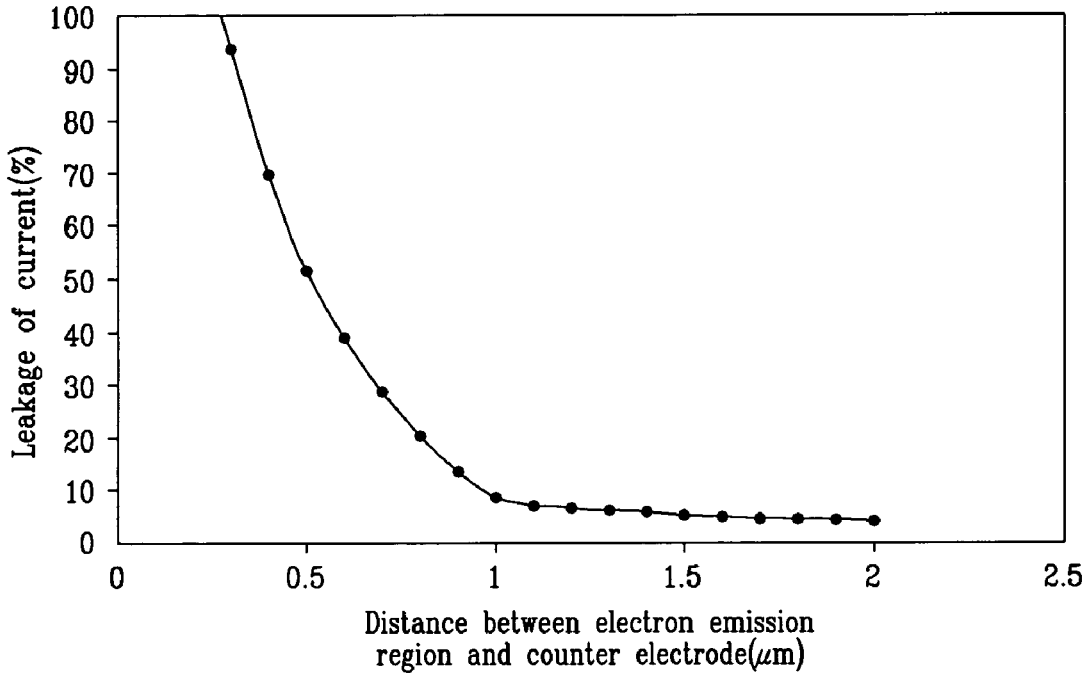
FIG. 8 is a graph illustrating the leakage current depending upon the variation in the distance between the electron emission regions and the counter electrodes.

On the other hand, in order to identify the minimum distance between the electron emission region 12 and the counter electrode 18, a leakage of a current depending upon the variation in the distance between the electron emission region 12 and the counter electrode 18 is illustrated in FIG. 8. The leakage of the current between the electron emission region and the counter electrode is irrelevant to the thickness of the insulating layer.

As shown in FIG. 8, within the range where the distance between the electron emission region and the counter electrode is about 2 μm or less, the smaller the distance between the electron emission region and the counter electrode, the more the leakage of the current is increased, and when the distance between the electron emission region and the counter electrode is about 1 μm or less, the leakage of the current is radically increased. Considering the experimental results, the distance between the electron emission region and the counter electrode should be about 1 μm or more.

As described above, in a case where one or more inflection points are existent at the line indicating the intensity of the electric field applied to the electron emission regions 12, the distance between the electron emission region 12 and the counter electrode 18 does not exceed the largest distance between the electron emission region 12 and the counter electrode 18 at those inflection points, or the distance does not exceed the smallest distance between the electron emission region 12 and the counter electrode 18 at those inflection points.

Furthermore, in a case where one inflection point is existent at the electric field intensity line, the distance between the electron emission region and the counter electrode 18 does not exceed the distance between the electron emission region 12 and the counter electrode at that one inflection point. Regardless of the number of inflection point(s), the distance between the electron emission region 12 and the counter electrode 18 should be about 1 μm or more.

The distance between the electron emission region 12 and the counter electrode 18 can be expressed by the following:

$$1(\mu m) \leqq D \leqq 28.1553 + 1.7060t(\mu m) \quad (2)$$

In this case, the thickness t of the insulating layer is in the range of about 0.5-30 μm.

On the other hand, if the maximum distance between the electron emission region 12 and the counter electrode 18 exceeds the distance where the inflection point is present, the intensity of the electric field applied to the electron emission region 12 can be heightened, but electrons are liable to be charged at the surface of the insulating layer 8. That is, the exposed area of the insulating layer 8 placed between the electron emission region 12 and the counter electrodes 18 that are not covered by these electrodes 8 and 12 is enlarged so that the surface of the insulating layer 8 at that area may be charged with electrons.

The electron charging of the insulating layer 8 induces uncontrollable emission or arc discharging, thereby deteriorating the stable display characteristic of the electron emission device. Furthermore, the so-called diode emission where electrons are falsely emitted due to the anode electric field at the off-stated pixels is liable to be made. For this reason, too high of a voltage should not be applied to the anode electrode 24, and a limit is made in heightening the screen luminance.

Figure 9:
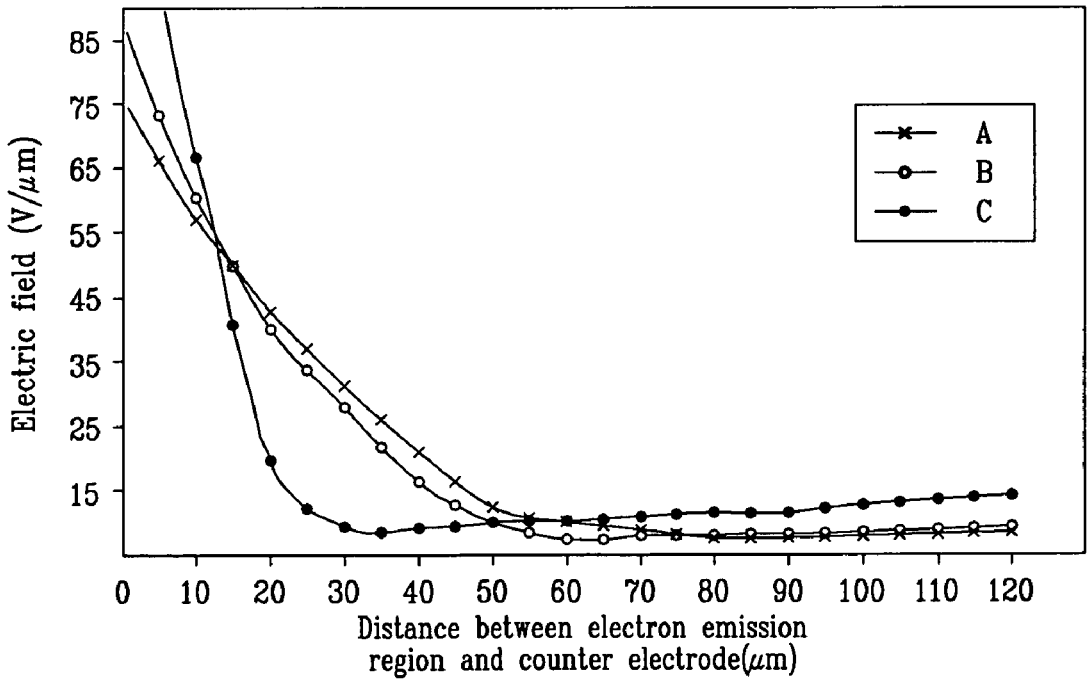
FIG. 9 is a graph illustrating the electric field intensity depending upon the variation in the distance between the electron emission regions and the counter electrodes with an electron emission device according to a second embodiment of the present invention.

With a second embodiment of the present invention, a maximum distance between the electron emission region 12 and the counter electrode 18 is numerically provided. FIG. 9 illustrates the electric field intensity of the electron emission regions as a function of the variation in the distance between the electron emission region 12 and the counter electrode 18 according to the second embodiment. The result illustrated in FIG. 9 is measured under the driving conditions different from those related to the results illustrated in FIGS. 6A to 6C.

In the drawing, the A curve indicates a case where the thickness of the insulating layer is about 30 μm, the B curve indicates a case where the thickness of the insulating layer is about 25 μm, and the C curve indicates a case where the thickness of the insulating layer is about 1 μm. In these three cases, the electron emission devices have the same structure except for the thickness of the insulating layer, and the experiments were made under the condition that about 100V is applied to the gate electrodes, about 0V is applied to the cathode electrodes, and about 1 kV is applied to the anode electrode.

As shown in FIG. 9, with the case where the thickness of the insulating layer is about 30 μm and the case where the thickness of the insulating layer is about 25 μm, the smaller the distance between the electron emission region and the counter electrode, the more the electric field intensity is reduced. When the distance between the electron emission region and the counter electrode reaches about 50 μm, the electric field intensity is increased proportional to the reduction in that distance. That is, with the A and B curves, the inflection point, where the electric field intensity is first decreased and then increased as the distance between the electron emission region and the counter electrode is changed (increased or reduced), is present where the distance between the electron emission region and the counter electrode is about 50 μm.

In the case where the thickness of the insulating layer is about 1 μm, the smaller the distance between the electron emission region and the counter electrode, the more the electric field intensity is decreased. When the distance between the electron emission region and the counter electrode reaches about 35 μm, the electric field intensity is radically increased. That is, with the C curve, the inflection point, where the electric field intensity is first decreased and then increased as the distance between the electron emission region and the counter electrode is changed (increased or reduced), is present where the distance between the electron emission region and the counter electrode is about 35 μm.

Accordingly, in the above three cases showing different thicknesses of the insulating layer, the distance between the electron emission region and the counter electrode should be set at a distance smaller than the distance between the electron emission region and the counter electrode where the inflection point is present. Therefore, in one embodiment of the present invention, the distance between the electron emission region and the counter electrode is established to be about 30 μm or less.

Furthermore, when the distance between the electron emission region and the counter electrode is about 15 μm or less, with the above three cases showing different thicknesses of the insulating layer, the intensity of the electric field applied to the electron emission regions exceeds 60V/μm. Therefore, in one embodiment of the present invention, the distance between the electron emission region and the counter electrode is established to be 15 μm or less.

As such and in view of the foregoing, the distance between the electron emission region and the counter electrode is established to be about 1 to 30 μm, or to be about 1 to 15 μm. Accordingly, with the electron emission device according to the embodiment of FIG. 9, the leakage of the current is minimized, and the effect of reinforcing the electric field due to the counter electrodes is maximized, thereby increasing the amount of emitted electrons, and lowering the driving voltage.

Electron emission devices according to certain other embodiments of the present invention will be now described. In these certain embodiments, a distance between an electron emission region and a counter electrode can be established to be the same as the distance described for the embodiments of FIGS. 1 to 9.

Figure 10:
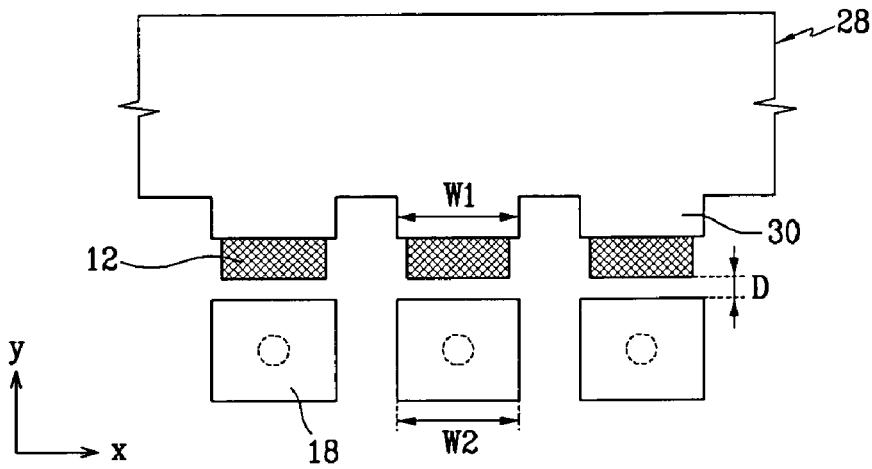
FIG. 10 is a partial plan view of a first substrate of an electron emission device according to a third embodiment of the present invention.

As shown in FIG. 10, protrusions 30 are formed at the one-sided peripheries of the cathode electrodes 28 facing the counter electrodes 18, and the electron emission regions contact the protrusions 30. A width, W1, of the protrusion 30 measured in the longitudinal direction of the cathode electrode 28 is established to be the same as a width, W2, of the counter electrode 18 measured in that direction.

The protrusions 30 are selectively formed at the portions of the cathode electrodes 28 (or only at the portions of the cathode electrodes 28) facing the counter electrodes 18, thereby reducing the effect of the electric field operated at a given pixel to the neighboring pixels, and controlling the driving per the respective pixels more precisely.

Figure 11:
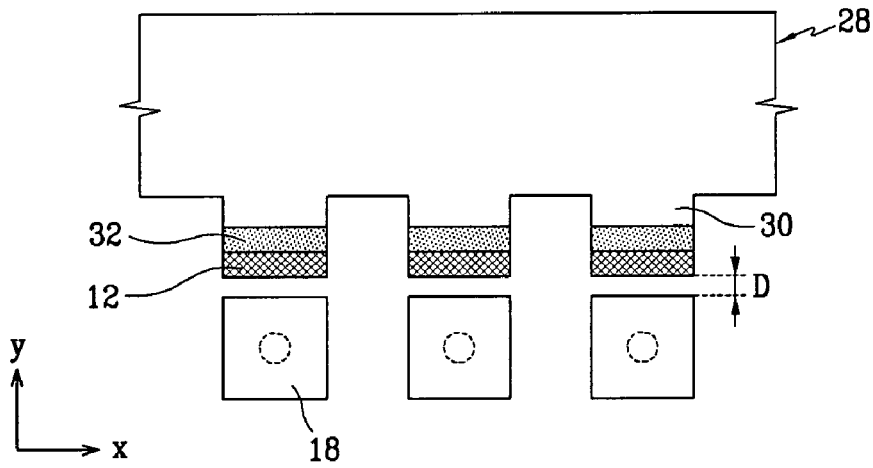
FIG. 11 is a partial plan view of a first substrate of an electron emission device according to a fourth embodiment of the present invention.

As shown in FIG. 11, with an electron emission device according to a fourth embodiment of the present invention, resistance layers 32 are formed between the cathode electrode 28 and the electron emission regions 12. Particularly, the resistance layers 32 may be disposed between the protrusions 30 of the cathode electrode 28 and the electron emission regions 12. The resistance layers 32 can have a specific resistivity of about $0.01\text{-}10^{10}\Omega/\text{cm}$, and uniformly control the amount of electrons emitted from the electron emission regions 12 per the respective pixels.

Figure 12:
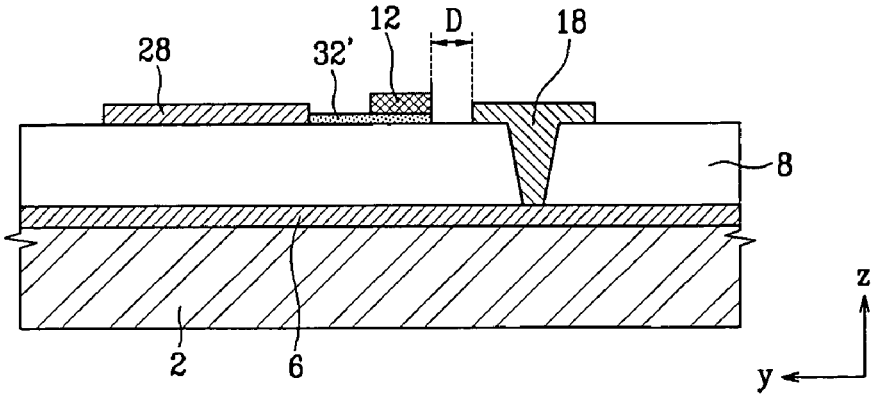
FIG. 12 is a partial sectional view of the first substrate of the electron emission device according to the fourth embodiment of the present invention, illustrating a variant of the resistance layers and the electron emission regions.

In the fourth embodiment, the electron emission regions 12 are formed on the insulating layer 8 while contacting lateral sides of the resistance layers 32. As shown in FIG. 12, the resistance layers 32' in one embodiment may also be extended toward the counter electrodes 18, and the electron emission regions 12 are formed on the resistance layers 32'. In one embodiment, thickness of the resistance layers 32' is about 0.5 μm or less, which is smaller than the thickness of the insulating layer 8. As such, the electron emission regions 12 and the counter electrodes 18 are placed substantially at about the same plane.

As also shown in FIG. 12, in a case where the electron emission region 12 is formed on the resistance layer 32', the contact area between the electron emission region 12 and the resistance layer 32' is increased, thereby further heightening the effect of the resistance layer 32'.

Figure 13:
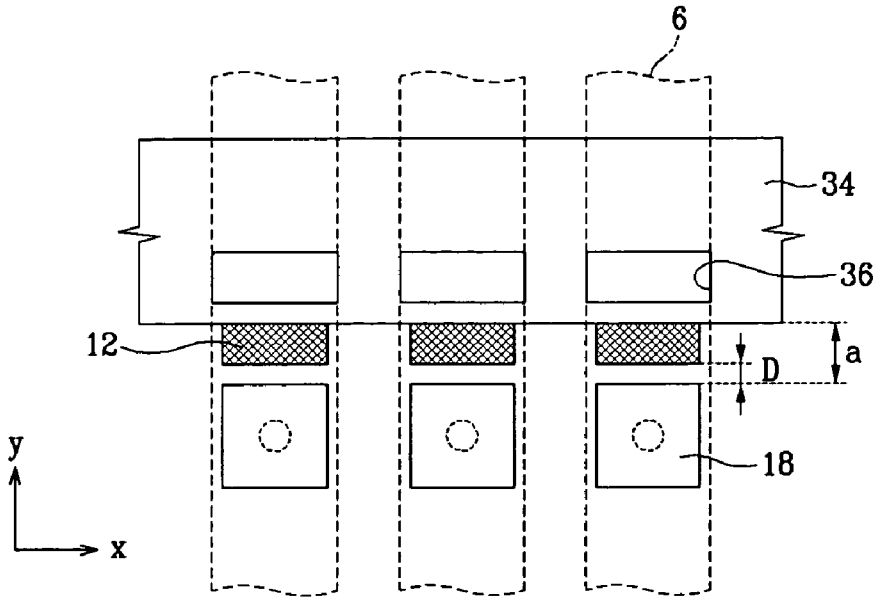
FIG. 13 is a partial plan view of a first substrate of an electron emission device according to a fifth embodiment of the present invention.

As shown in FIG. 13, with an electron emission device according to a fifth embodiment of the present invention, opening portions 36 are formed at the cathode electrode 34 while partially exposing the surface of the insulating layer. Accordingly, the electric fields of the gate electrodes 6 placed under the opening portions 36 pass through the insulating layer and the opening portions 36, and affect the electron emission regions 12, thereby forming stronger electric fields around the electron emission regions 12 during an operation of the electron emission device.

Figure 14:
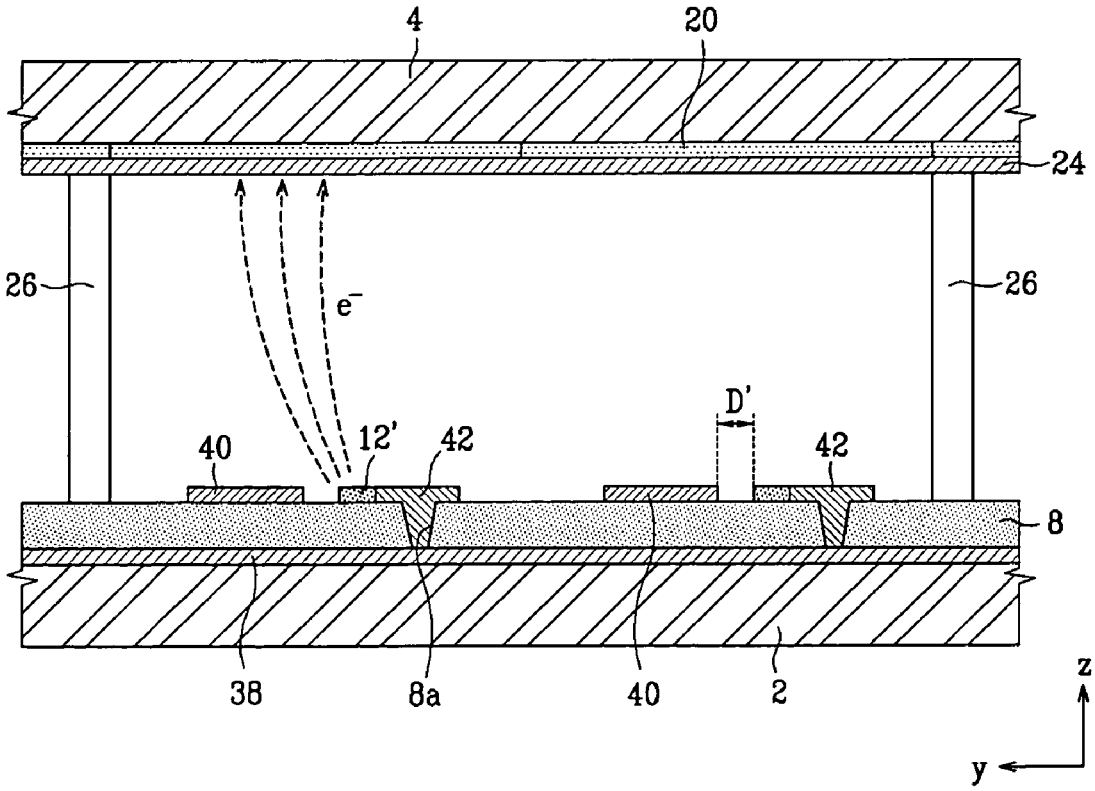
FIG. 14 is a partial sectional view of an electron emission device according to a sixth embodiment of the present invention.
Figure 15:
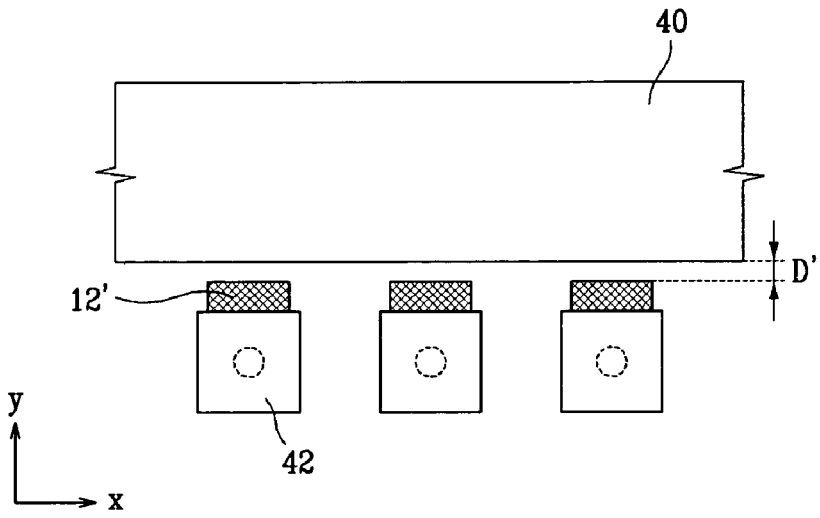
FIG. 15 is a partial plan view of the first substrate of the electron emission device according to the sixth embodiment of the present invention.

As shown in FIGS. 14 and 15, with an electron emission display according to a sixth embodiment of the present invention, first cathode electrodes 38 are stripe-patterned on the first substrate 2 in a first direction of the first substrate 2 (e.g., in a y-axis direction of FIGS. 14 and 15), and an insulating layer 8' is formed on the entire surface of the first substrate 2 while covering the first cathode electrodes 38. Gate electrodes 40 are formed on the insulating layer 8' while proceeding in a second direction crossing the first cathode electrodes 38 (e.g., in an-x axis direction of FIG. 15).

Second cathode electrodes 42 are formed on the insulating layer 8 between the gate electrodes 40, and electron emission regions 12' are formed on the insulating layer 8' while contacting the second cathode electrodes 42. The second cathode electrodes 42 contact the first cathode electrodes 38 through via holes **8*a*' formed at the insulating layer 8' while being electrically connected thereto. The second cathode electrodes 42 and the electron emission regions 12' are provided at the respective pixel regions defined on the first substrate 2**.

A distance D' between the electron emission region 12' and the gate electrode 40 can be established to be the same as the distance D between the electron emission region and the counter electrode, described for the embodiments of FIGS. 1 to 9.

Figure 16:
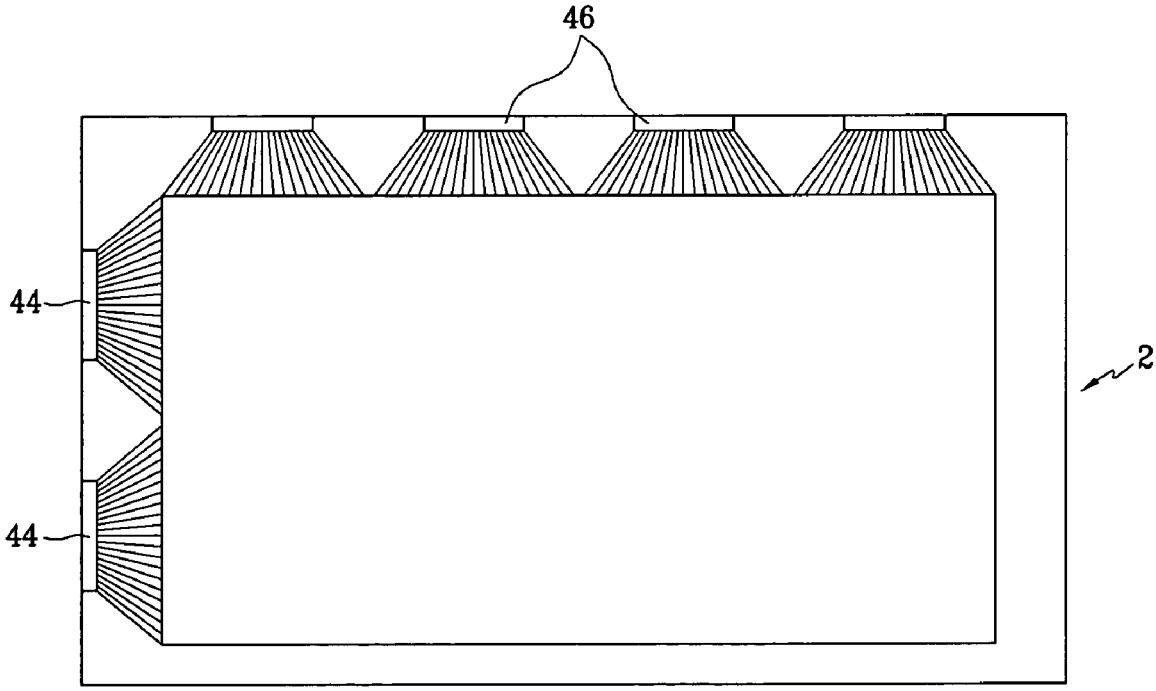
FIG. 16 is a plan view of the first substrate of the electron emission device according to the sixth embodiment of the present invention.

As shown in FIG. 16, in one embodiment, gate electrodes (e.g., the gate electrodes 40 of FIGS. 14 and 15) receive scanning signal voltages from a scanning signal application unit 44 and are used as the scanning electrodes. In addition, first cathode electrodes (e.g., the first cathode electrodes 38 of FIGS. 14 and 15) on the first substrate 2 receive data signal voltages from a data signal application unit 46 and are used as the data electrodes.

Figure 17:
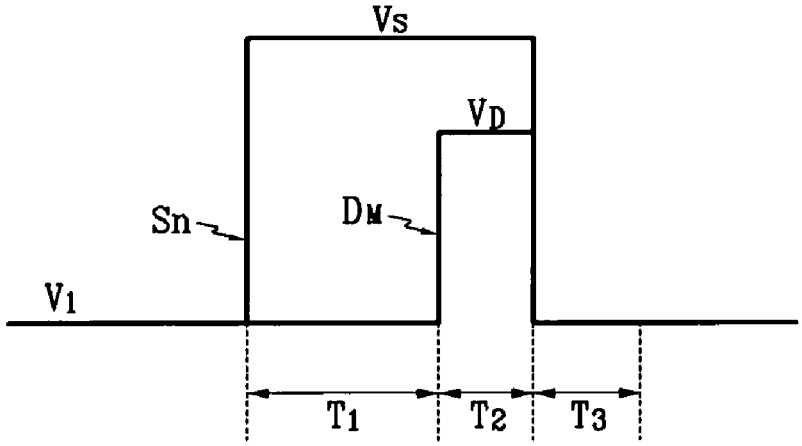
FIG. 17 is a drive waveform chart illustrating an instance of drive waveforms capable of being applied to the electron emission device according to the sixth embodiment of the present invention.

FIG. 17 illustrates the driving waveform to be applied to the electron emission display according to the sixth embodiment of the present invention. For convenience, the gate electrodes will be referred to as the "scanning electrodes," and the first and/or the second cathode electrodes will be referred to as the "data electrodes."

As shown in FIG. 17, an on voltage $V_S$ of a scanning signal is applied to a scanning electrode Sn within the period of T1. In addition, an on voltage $V_1$ of a data signal is applied to the data electrode $D_M$. Electrons are emitted from the electron emission region due to the difference $V_S-V_1$ of the voltages applied to the scanning electrode Sn and the data electrode $D_M$, and collide against phosphor layers (e.g., the phosphor layers 20 of FIGS. 1, 2, and/or 14) to thereby emit light.

Thereafter, the on voltage $V_S$ of the scanning signal is sustained at the scanning electrode Sn within the period of T2, and an off voltage $V_D$ of the data signal is applied to the data electrode Dm. As such, the difference of the voltages applied to the scanning electrode Sn and the data electrode Dm is reduced to be $V_S-V_D$ such that electrons are not emitted from the electron emission region. The grays can be properly expressed by varying the pulse width within the sections of T1 and T2.

With the period of T3, an off voltage V1 of the scanning signal is applied to the scanning electrode Sn, and an off voltage V1 of the data signal is applied to the data electrode Dm such that electrons are not emitted from the electron emission region. At this time, the off voltage V1 of the scanning signal is established to be the same as the on voltage V1 of the data signal or is commonly established to be 0V.

In view of the foregoing, with the structure where electron emission regions are electrically connected to the first and the second cathode electrodes for receiving the data signals, the maximum electric current value required for the electron emission is divided by the number of the data electrodes. That is, when the electron emission device makes formation of a full-white screen, the amount of electrons emitted from the plurality of electron emission regions corresponding to one scanning electrode should be maximized. The maximum electric current value required for the electron emission is restricted by (or partially burdened to) all the data electrodes so that the current is flown to the respective data electrodes with the maximum electric current value divided by the number of data electrodes.

Accordingly, with the electron emission device according to the embodiments of FIGS. 14 to 17, a luminance difference is not made in the direction of the gate electrodes (e.g., in the horizontal direction of the screen). In addition, when the current flowing through the cathode electrodes is small even with the presence of a line resistance of several mega ohms (MΩ) at a first cathode electrode, the luminance deterioration due to the voltage drop is still extremely low.

Figure 18:
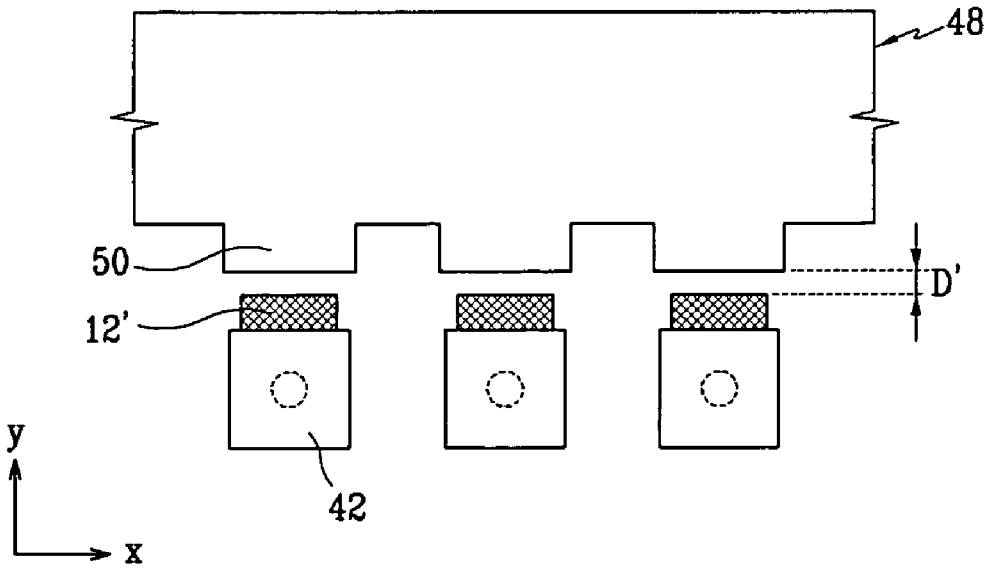
FIG. 18 is a partial plan view of a first substrate of an electron emission device according to a seventh embodiment of the present invention.

As shown in FIG. 18, an electron emission device according to a seventh embodiment of the present invention has the same basic structural components as those related to the sixth embodiment except that protrusions 50 are formed at one-sided portions of the gate electrodes 48 facing the electron emission regions 12'. The protrusions 50 are used to provide a minute distance between the electron emission regions 12' and the gate electrodes 48, and to reduce the effect of the electric field operated at a given pixel to the neighboring pixels, thereby driving the respective pixels more precisely.

Figure 19:
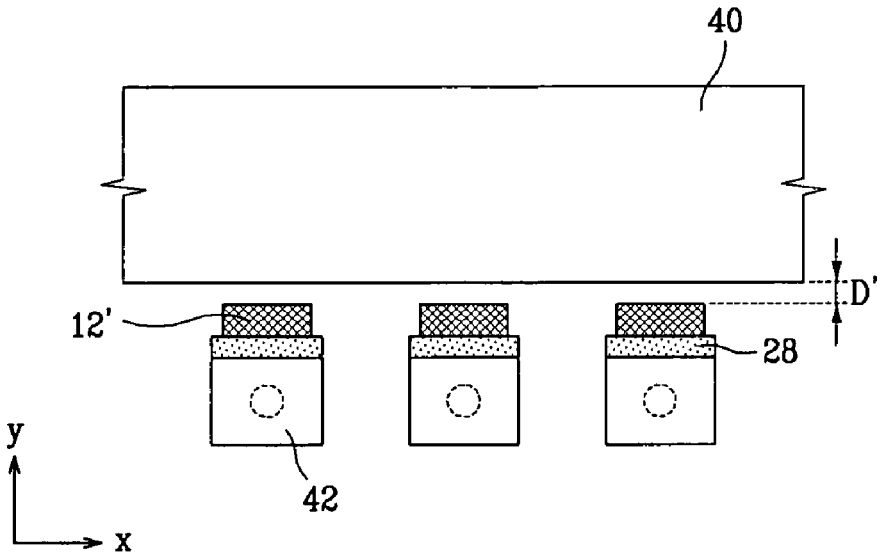
FIG. 19 is a partial plan view of a first substrate of an electron emission device according to an eighth embodiment of the present invention.
Figure 20:
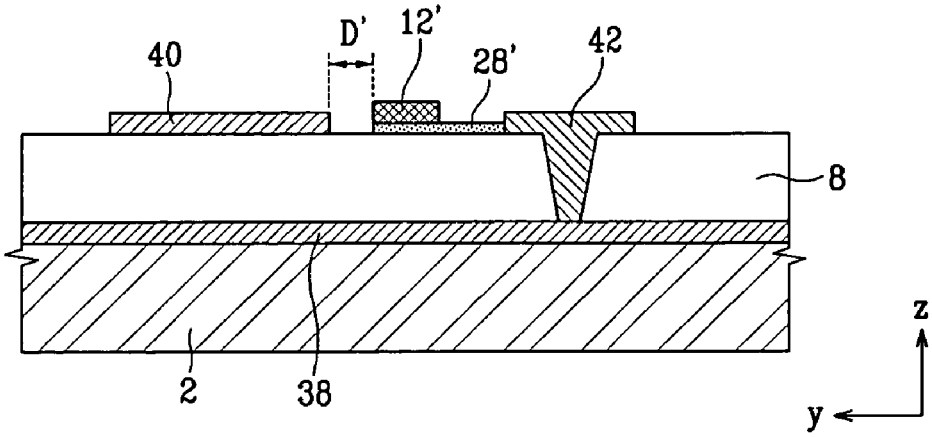
FIG. 20 is a partial sectional view of the first substrate of the electron emission device according to the eighth embodiment of the present invention, illustrating the variants of the resistance layers and the electron emission regions.

As shown in FIG. 19, an electron emission device according to an eighth embodiment has the same basic structural components related to the sixth embodiment and/or the seventh embodiment except that resistance layers 28 are formed between the second cathode electrodes 42 and the electron emission regions 12'. The electron emission regions 12' are formed on the insulating layer 8 while contacting lateral sides of the resistance layers 28. As shown in FIG. 20, in one embodiment, the electron emission regions 12' may also be formed on the resistance layers 28'.

In one embodiment, the electron emission regions 12' are formed on the resistance layers 28', and the thickness of the resistance layers 28' is about 0.5 μm or less, which is substantially smaller than the thickness of the insulating layer 8. As such, it can be assumed that the electron emission regions 12 and the gate electrodes 40 are placed substantially at about the same plane.

Figure 21:
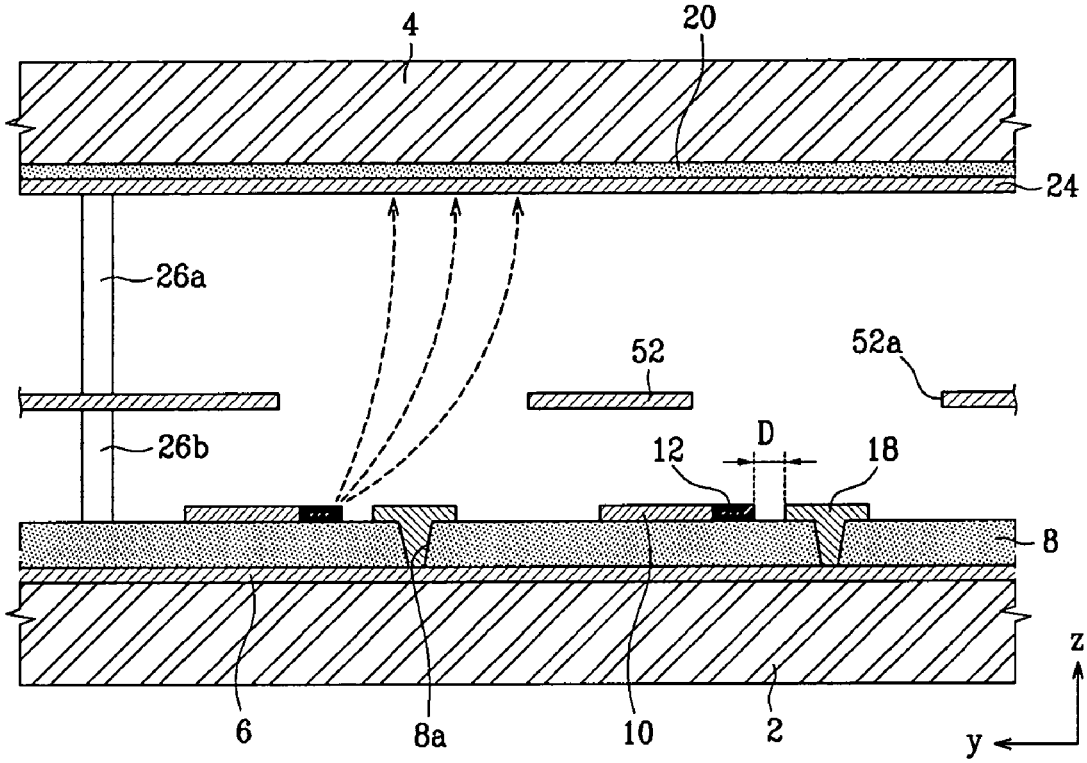
FIG. 21 is a partial sectional view of an electron emission device according to a ninth embodiment of the present invention.

Referring now to FIG. 21, a grid electrode 52 is disposed between the first and the second substrates 2 and 4 with a plurality of electron beam passage holes 52*a* according to a ninth embodiment of the present invention. The grid electrode 52 focuses the electrons directed toward the second substrate 4, and intercepts the effect of the anode electric field to the electron emission regions 12, thereby preventing diode light emission due to the anode electric field.

In addition, FIG. 21 shows that upper spacers 26*a* are disposed between the second substrate and the grid electrode, and the lower spacers 26*b* are disposed between the first substrate and the grid electrode.

In view of the forgoing foregoing, with the electron emission device according to certain embodiments of the present invention, the leakage of the current between the electron emission regions and the gate electrodes is minimized, and the intensity of the electric field applied to the electron emission regions is heightened. As a result, the amount of emitted electrons is increased, thereby enhancing the screen luminance and the color representation, and lowering the power consumption.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a plurality of gate electrodes formed on a first substrate, the gate electrodes being located on a first plane;

an insulating layer formed on the gate electrodes;

a plurality of cathode electrodes formed on the insulating layer;

a plurality of electron emission regions electrically connected to the cathode electrodes, the electron emission regions being located on a second plane; and a plurality of counter electrodes placed substantially on the second plane of the electron emission regions;

wherein the gate electrodes and the counter electrodes are for receiving a same voltage; and wherein a distance, D, between at least one of the electron emission regions and at least one of the counter electrodes satisfies the following condition:

$$1\ \mu m \leqq D \leqq 28.1553 + 1.7060t\ \mu m$$

where t indicates a thickness of the insulating layer.

2. The electron emission device of claim 1 wherein the insulating layer has a thickness of about 0.5 to 30 μm.

3. The electron emission device of claim 1 wherein the gate electrodes are positioned closer to the first substrate than the cathode electrodes.

4. The electron emission device of claim 3 wherein the counter electrodes are formed on the insulating layer while contacting the gate electrodes through via holes formed at the insulating layer.

5. The electron emission device of claim 1 wherein the electron emission regions are formed on the insulating layer such that lateral sides of the electron emission regions contact lateral sides of the cathode electrodes.

6. The electron emission device of claim 1 further comprising a plurality of resistance layers disposed between the cathode electrodes and the electron emission regions.

7. The electron emission device of claim 1 wherein opening portions are formed internally at the cathode electrodes to expose a surface of the insulating layer.

8. The electron emission device of claim 1 wherein the electron emission regions are formed with a material selected from the group consisting of carbon nanotube, graphite, graphite nanofiber, diamond, diamond-like carbon, $C_{60}$, and silicon nanowire materials.

9. The electron emission device of claim 1 further comprising:

a second substrate facing the first substrate;

a plurality of phosphor layers and an anode electrode formed on the second substrate; and a grid electrode disposed between the first and the second substrates.

10. An electron emission device comprising:

a plurality of gate electrodes formed on a substrate, the gate electrodes being located on a first plane;

an insulating layer formed on the gate electrodes;

a plurality of cathode electrodes formed on the insulating layer;

a plurality of electron emission regions electrically connected to the cathode electrodes, the electron emission regions being located on a second plane; and a plurality of counter electrodes placed substantially on the second plane of the electron emission regions;

wherein the gate electrodes and the counter electrodes are for receiving a same voltage;

wherein, when voltages are applied to the cathode electrodes and the gate electrodes, one or more inflection points of an electric field intensity are present; and wherein, when a distance between at least one of the electron emission regions and at least one of the counter electrodes is indicated by D, and a largest distance between the at least one electron emission region and the at least one counter electrode at the inflection points is indicated by d1, the distance, D, between the at least one electron emission region and the at least one counter electrode satisfies the following condition:

$$1\ \mu m \leqq D \leqq d1\ \mu m.$$

11. The electron emission device of claim 10 wherein the distance, D, between the at least one electron emission region and the at least one counter electrode satisfies the following two conditions:

$$1\ \mu m \leqq D \leqq 28.1553+1.7060t\ \mu m, \text{ and}$$

$$0.5\ \mu m \leqq t \leqq 30\ \mu m$$

where t indicates a thickness of the insulating layer.

12. An electron emission device comprising:

a plurality of gate electrodes formed on a first substrate, the gate electrodes being located on a first plane;

an insulating layer formed on the gate electrodes;

a plurality of cathode electrodes formed on the insulating layer;

a plurality of electron emission regions electrically connected to the cathode electrodes, the electron emission region being formed on a second plane; and a plurality of counter electrodes placed substantially on the second plane of the electron emission regions;

wherein the gate electrodes and the counter electrodes are for receiving a same voltage; and wherein at least one of the electron emission regions and at least one of the counter electrodes are spaced apart from each other with a distance of about 1 to 30 μm.

13. The electron emission device of claim 12 wherein the at least one electron emission region and the at least one gate electrode are spaced apart from each other with the distance of about 1 to 15 μm.

14. The electron emission device of claim 12 wherein the gate electrodes are positioned closer to the first substrate than the cathode electrodes.

15. The electron emission device of claim 14 wherein the counter electrodes are formed on the insulating layer while contacting the gate electrodes through via holes formed at the insulating layer.

16. The electron emission device of claim 12 wherein the electron emission regions are formed on the insulating layer such that lateral sides of the electron emission regions contact lateral sides of the cathode electrodes, and wherein the electron emission regions are partially protruded from one-sided peripheries of the cathode electrodes facing the counter electrodes toward the counter electrodes.

17. The electron emission device of claim 12 wherein the cathode electrodes have a plurality of protrusions directed toward the counter electrodes, and wherein the electron emission regions contact the protrusions.

18. The electron emission device of claim 12 further comprising a plurality of resistance layers disposed between the cathode electrodes and the electron emission regions.

19. The electron emission device of claim 12 further comprising:

a second substrate facing the first substrate;

a plurality of phosphor layers and an anode electrode formed on the second substrate; and a grid electrode disposed between the first and the second substrates.

20. An electron emission device comprising:

a plurality of first cathode electrodes formed on a first substrate, the first cathode electrodes being located on a first plane;

an insulating layer formed on the first cathode electrodes;

a plurality of gate electrodes formed on the insulating layer, the gate electrodes being located on a second plane;

a plurality of second cathode electrodes placed substantially on the second plane of the gate electrodes; and a plurality of electron emission regions electrically connected to the second cathode electrodes;

wherein the first cathode electrodes and the second cathode electrodes are for receiving a same voltage; and wherein at least one of the electron emission regions and at least one of the gate electrodes are spaced apart from each other with a distance of about 1 to 30 μm.

21. The electron emission device of claim 20 wherein the at least one electron emission region and the at least one gate electrode are spaced apart from each other with the distance of about 1 to 15 μm.

22. The electron emission device of claim 20 wherein the first cathode electrodes are positioned closer to the first substrate than the gate electrodes.

23. The electron emission device of claim 22 wherein the second cathode electrodes are formed on the insulating layer while contacting the first cathode electrodes through via holes formed at the insulating layer.

24. The electron emission device of claim 20 wherein the electron emission regions are formed on the insulating layer such that the lateral sides of the electron emission regions contact lateral sides of the second cathode electrodes.

25. The electron emission device of claim 20 wherein the gate electrodes have a plurality of protrusions directed toward the electron emission regions.

26. The electron emission device of claim 20 further comprising a plurality of resistance layers disposed between the second cathode electrodes and the electron emission regions.

27. The electron emission device of claim 20 wherein the gate electrodes are electrically connected to a scanning signal application unit, and the first cathode electrodes are electrically connected to a data signal application unit.

28. The electron emission device of claim 20 further comprising:

a second substrate facing the first substrate;

a plurality of phosphor layers and an anode electrode formed on the second substrate; and a grid electrode disposed between the first and the second substrates.

* * * * *